US007266939B1

(12) United States Patent
Woodall et al.

(10) Patent No.: US 7,266,939 B1
(45) Date of Patent: Sep. 11, 2007

(54) MOISTURE-ABSORBING CELLULOSE-BASED MATERIAL AND METHOD FOR MAKING SAME

(75) Inventors: Robert Woodall, Panama City Beach, FL (US); Felipe Garcia, Panama City, FL (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 253 days.

(21) Appl. No.: 10/768,752

(22) Filed: Jan. 23, 2004

(51) Int. Cl.
*D02G 3/02* (2006.01)

(52) U.S. Cl. ..... 57/252

(58) Field of Classification Search ..... 19/66 CC, 19/115 R, 236; 57/252, 258
See application file for complete search history.

(56) References Cited

U.S. PATENT DOCUMENTS 4,552,803 A * 11/1985 Pearson ..... 442/142
6,561,023 B2 * 5/2003 Woodall et al. ..... 73/335.06
6,802,260 B2 * 10/2004 Woodall et al. ..... 102/408
2002/0182962 A1 * 12/2002 Woodall et al. ..... 442/327
2002/0189484 A1 * 12/2002 Woodall et al. ..... 102/408

OTHER PUBLICATIONS

Katheryn L Hatch, Textile Science, 1993, West Publishing Company, 1st edition, pp. 272-273.*

* cited by examiner

*Primary Examiner*—Shaun R. Hurley
(74) *Attorney, Agent, or Firm*—James T. Shepherd

(57) ABSTRACT

A moisture-absorbing material and method of making same are provided. Hollow fibrous tubes of cotton are sequentially dried, combed in a direction to substantially longitudinally align the hollow fibrous tubes of cotton, and stretched, twisted about and compressed in this direction. A powder material can be mixed with the hollow fibrous tubes of cotton. The powder material is inert with respect to the hollow fibrous tubes of cotton and initiates a chemical reaction that generates water when exposed to water.

8 Claims, 2 Drawing Sheets

MOISTURE-ABSORBING CELLULOSE-BASED MATERIAL AND METHOD FOR MAKING SAME

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to moisture-absorbing materials, and more particularly to a cellulose-based moisture-absorbing material capable of achieving mechanical work during absorption.

BACKGROUND OF THE INVENTION

Moisture-absorbing materials are used in a variety of everyday household items such as bath towels, paper towels, diapers, sponges, etc. The design goal of each of these items is to maximize absorption for a given surface area without any concern for how the item grows or expands as a result of such absorption.

In other specialized applications of moisture-absorbing materials, it may be desirable to harness the expansion of the moisture-absorbing material to perform work. For example, a mechanical water sensor described in U.S. Pat. No. 6,182,507, uses compressed cotton balls constrained in an open frame as a means to absorb water and expand where the force of expansion is used to move a piston. However, compressed cotton balls do not provide a reliable means of moisture absorption in harsh underwater environments and, therefore, are not reliable as a means of producing work when subjected to immersion in such environments. This is because the compressed cotton balls rely on surface absorption of moisture for its expansion. However, high-levels of naturally-occurring impurities and man-made pollutants often found in underwater environments can cover the surface area of the cotton thereby impeding the absorption of water.

More recently, a water sensing actuator described in U.S. Pat. No. 6,561,023, discloses a moisture-absorbing material that is based on a fibrous cellulosic material having anisotropic moisture-absorbing properties such that its dried-in strain is greatest along one axis thereof. A powder material coats, and can be mixed with, the cellulosic material. The powder material is inert with respect to the cellulosic material and initiates a chemical reaction when exposed to water such that a product of the chemical reaction is water. While this material was found to absorb water and expand even in impure water environments, the direction of such expansion was somewhat unpredictable thereby requiring a housing encasing the material to control such expansion.

SUMMARY OF THE INVENTION

Accordingly, it is an object of the present invention to provide a moisture-absorbing material and method for making same that yields a moisture-absorbing, work-producing-material capable of expanding in a predictable and reliable way.

Other objects and advantages of the present invention will become more obvious hereinafter in the specification and drawings.

In accordance with the present invention, a moisture-absorbing material and method of making same are provided. The moisture-absorbing material comprises hollow fibrous tubes of cotton that have been sequentially (i) dried, (ii) combed in a direction to substantially longitudinally align the hollow fibrous tubes of cotton, (iii) stretched in this direction, (iv) twisted about this direction, and (v) compressed in this direction. As a result, a dried-in strain of the hollow fibrous tubes of cotton is greatest along this direction. A powder material can be mixed with the hollow fibrous tubes of cotton. As a result, the powder material adheres to and can reside within the hollow fibrous tubes of cotton. The powder material is inert with respect to the hollow fibrous tubes of cotton and initiates a chemical reaction when exposed to water. It is generally preferred that a product of the chemical reaction be water.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
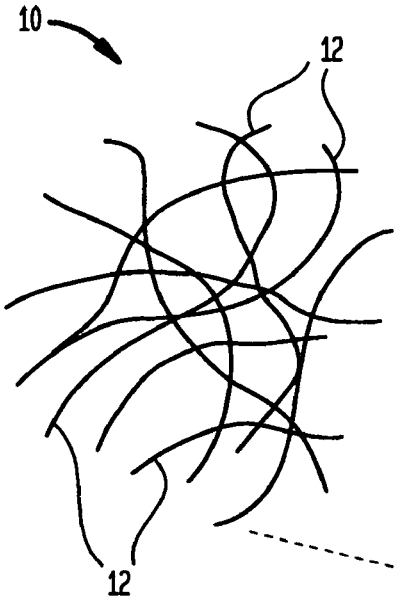
FIG. 1 is a schematic diagram illustrating a microscopic abstraction of the hollow fibrous tubes that define a natural cellulosic material prior to processing according to the present invention.
Figure 2:
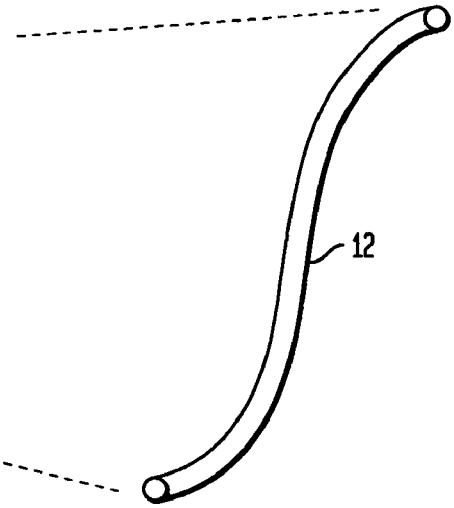
FIG. 2 is an isolated and enlarged view of one of the hollow fibrous tubes from the natural cellulosic material.

Referring now to the drawings, and more particularly to FIG. 1, a microscopic abstraction of a plant-based or natural cellulosic material is shown in a state that is referenced generally by numeral 10. That is, prior to processing in accordance with the present invention, material state 10 defines a plurality of randomly-oriented, hollow fibrous tubes 12, one of which is enlarged in FIG. 2.

In general, the material that serves as the base for the present invention can be any natural cellulosic material that is (or can be processed in way well known in the art to be) comprised of hollow fibrous tubes 12 prior to being processed to produced the improved moisture-absorbing material of the present invention. Note, however, that better moisture-absorption and material expansion is achieved by starting with materials defined by long and flexible hollow fibrous cellulosic tubes. Such materials include cotton, hemp, kapok and milkweed, with cotton being preferred owing to its high linear hollow microfibril cellulose content. As mentioned above, processing of the material to make it consist of hollow fibrous tubes is known in the art.

Processing of hollow fibrous tubes 12 in accordance with the present invention improves anisotropic behavior/properties in terms of the material's moisture-absorbing capabilities. That is, hollow fibrous tubes 12 are processed such that, when they are exposed to water, they behave in a predictable manner like a coil spring releasing its stored energy along a longitudinal axis of the coil spring.

Figure 3:
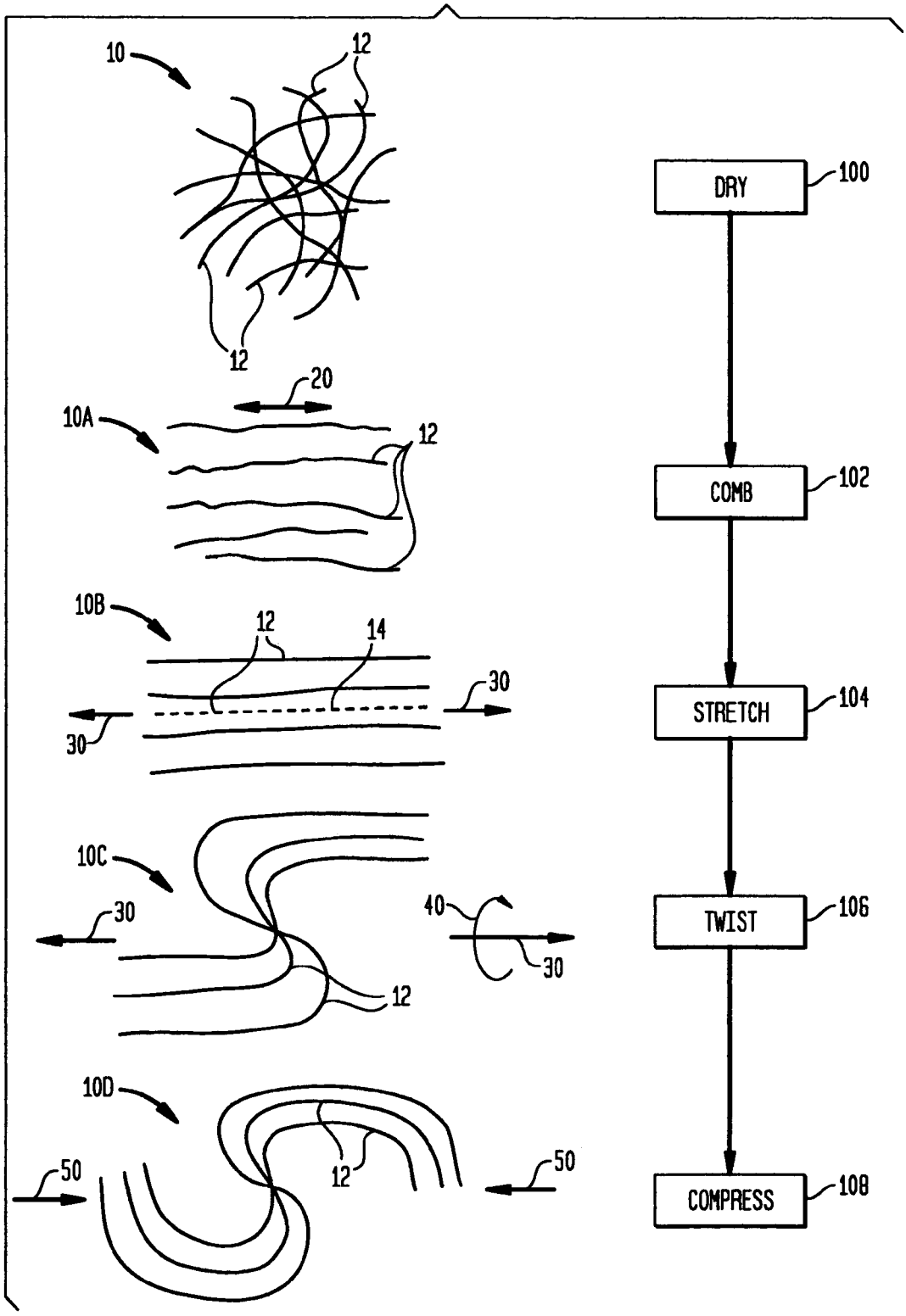
FIG. 3 is a series of schematic diagrams and an accompanying flowchart that illustrates and describes, respectively, the method of making the moisture-absorbing cellulose-based material in accordance with the present invention.

The present invention applies a series of sequential steps to change hollow fibrous tubes 12 from their state illustrated in FIG. 1 to a state where they can behave as a coil spring. These steps are illustrated in FIG. 3 where the left side of the figure depicts the results of the processing steps that are described by the flowchart on the right side of the figure. It is assumed that hollow fibrous tubes 12 in material state 10 are available for processing in accordance with the present invention.

At step 100, hollow fibrous tubes 12 in material state 10 are dried to remove any residual moisture on or within hollow fibrous tubes 12. Drying step 100 can include tumbling (i.e., a tumble dry operation) to expedite this step of the process. Tumble drying also fluffs the cotton fibers thereby increasing the overall surface area of the material. Next, at step 102, the dried hollow fibrous tubes 12 are combed (or raked as it is also known) along a direction indicated by two-headed arrow 20. As a result, hollow fibrous tubes 12 become aligned or substantially aligned longitudinally as shown. Regardless of the particular type of combing apparatus used, some of the tubes' inherent curls, twists, etc., will remain in the combed hollow fibrous tubes 12. Accordingly, the resulting material state illustrated at 10A shows hollow fibrous tubes 12 as being aligned in a longitudinal direction that is substantially commensurate with combing direction 20.

After combing step 102, hollow fibrous tubes 12 in material state 10A are stretched by means of an applied stretching force 30 at step 104 to thereby elongate and substantially straighten the natural curls in tubes 12. Stretching force 30 is applied along the same direction as combing direction 20. The resulting stretched hollow fibrous tubes 12 (forming material state 10B) are thus aligned along an axis 14 that is commensurate with combing direction 20 and stretching force 30.

After stretching step 104 has been started (or when it has been completed), hollow fibrous tubes 12 in their stretched material state 10B are twisted at step 106 collectively or in bundles about axis 14, i.e., the direction used for combing direction 20 and in which stretching force 30 is applied. Such twisting is indicated by twisting force arrow 40 which is indicative of the twisting of one end of hollow fibrous tubes 12. Note that twisting force 40 can be applied during or after the application of stretching force 30 without departing from the scope of the present invention.

The resulting twisted material state 10C is then ready for a compression step 108. Specifically, a compression force 50 is applied to hollow fibrous tubes 12 in twisted material state 10C along the same direction as the previously-applied stretching force 30. The resulting compressed material state 10D provides the moisture-absorbing material structure of the present invention. In its dry form, the structure of hollow fibrous tubes 12 in compressed material state 10D is analogous to a coil spring under compression along its spring axis, i.e., the direction defined by the aligned combing direction 20, direction of stretching force 30 and direction of compression force 50. The amount of time and force used to implement each step of the above-described process can be adapted for the particular application without departing from the scope of the present invention.

Tests based on the above-described process have produced a moisture-absorbing material that expands, when exposed to water, along the direction that the material was combed, stretched and compressed. Such controlled-direction expansion was achieved without any housing encasing the dry compressed material. By not requiring any encasement of the dry compressed material, the present invention can have its entire surface area exposed to an activating water environment thereby speeding up the process of expansion along a specific direction.

Figure 4:
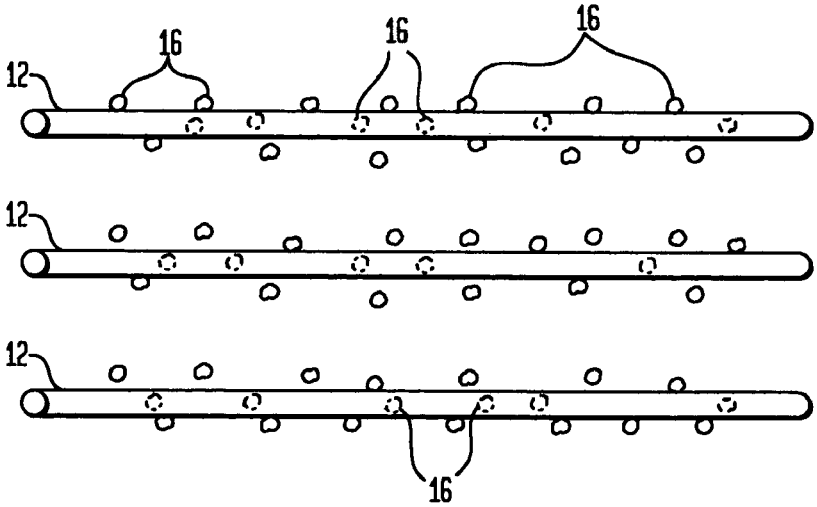
FIG. 4 is a schematic diagram of another embodiment of a moisture-absorbing material structure in accordance with the present invention.

The moisture-absorbing properties of the dry compressed material described herein can be further enhanced by mixing powder particles of a water-reactive material with hollow fibrous tubes 12. The mixing of powder particles 16 with tubes 12 can be achieved by tumbling the cellulosic material with powder particles 16 during drying step 100. Such "mixing-by-tumbling" processes are standard and well known within the art of cellulose processing. Additional powder particles 16 can be added during compression step 108. As a result of the mixing step(s), the powder particles (depending on their size) are located on, in between, and within hollow fibrous tubes 12 as illustrated in FIG. 4 where the powder particles are referenced by numeral 16. For clarity of illustration, FIG. 4 shows tubes 12 during the stretching thereof.

The material selected for powder particles 16 should be inert with respect to the cellulosic material and reactive with respect to the moisture (e.g., water) to be absorbed. Preferably, the material selected for powder particles 16 should also generate water as a product of its chemical reaction with water. For example, if powder particles 16 comprise a mixture of sodium bicarbonate ($NaHCO_3$) and citric acid ($H_3C_6H_5O_7$), a reaction of this mixture with water yields sodium citrate ($Na_3C_6H_5O_7$), carbon dioxide ($CO_2$) and water ($H_2O$). Another preferred example for powder particles 16 is a mixture of sodium bicarbonate ($NaHCO_3$) and potassium hydrogen tartrate ($KHC_4H_4O_6$). A reaction of this mixture with water yields potassium sodium tartrate ($KNaC_4H_4O_6$), carbon dioxide and water. Note that any amount of water is sufficient to start the reaction. Once started, no additional water is needed as the reaction self-produces water.

Upon immersion in water, powder particles 16 solvate with the heat of solvation being released/absorbed from the surroundings to increase or decrease the localized temperature of the reaction zone on the surface of the material. This localized temperature gradient induces a corresponding mass transfer increase between the hot and cold regions as they pursue thermal equilibrium. The thermal effect increases the mass transfer effect of adsorption at the surface of hollow fibrous tubes 12 that is in contact with water, i.e., this thermal effect increases the mass transfer effect of adsorption at the boundary that separates the wet versus dry portion of the material. If powder particles 16 also generate more water when chemically reacting with water, the additional water increases turbulence and changes concentration gradients which, in turn, increase the mass transfer effect of absorption at the surface of the material.

When immersed in water, the presence of powder particles 16 between and in tubes 12 provides an additional mass transfer effect that increases water adsorption and absorption. In addition, if one of the above-described sodium bicarbonate mixtures is used for powder particles 16, the generation of gaseous carbon dioxide not only improves adsorption and absorption, but also introduces the mass transfer effect of diffusion through the material.

The advantages of the present invention are numerous. A simple moisture-absorbing material is made from inexpensive/renewable natural cellulose materials and harmless chemicals. The material is processed in accordance with a novel method to provide a work-producing structure that will expand (i) in a predictable and reliable fashion even in impure, polluted or harsh water environments, and (ii) with or without the use of a housing encasing the dry compressed material.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A method of making a moisture-absorbing material that expands linearly upon moisture absorption comprising the steps of:

providing a natural cellulosic material that is defined by hollow fibrous tubes;

drying said natural cellulosic material;

combing, after said step of drying, said natural cellulosic material in a direction to substantially longitudinally align said hollow fibrous tubes;

stretching, after said step of combing, said hollow fibrous tubes substantially in said direction wherein said hollow fibrous tubes are placed in a stretched state;

twisting said hollow fibrous tubes in said stretched state substantially about said direction; and compressing, after said step of twisting, said hollow fibrous tubes in said direction, wherein a dried-in strain of said natural cellulosic material is greatest along said direction, and wherein said hollow fibrous tubes expand along said direction when exposed to moisture.

2. A method according to claim 1 further comprising the step of mixing a powder material with said hollow fibrous tubes wherein said powder material adheres to and resides in said hollow fibrous tubes, said powder material being inert with respect to said natural cellulosic material and initiating a chemical reaction when exposed to water, wherein a product of said chemical reaction is water.

3. A method according to claim 1 wherein said natural cellulosic material is cotton.

4. A method according to claim 2 wherein said powder material is selected from the group consisting of: a mixture of sodium bicarbonate and citric acid; and a mixture of sodium bicarbonate and potassium hydrogen tartrate.

5. A method according to claim 2 wherein said powder material is selected such that another product of said chemical reaction is gaseous.

6. A method of making a moisture-absorbing material that expands linearly upon moisture absorption comprising the steps of:

providing cotton in the form of hollow fibrous tubes thereof;

drying said cotton;

mixing, during said step of drying, a powder material with said hollow fibrous tubes wherein said powder material adheres to and resides in said hollow fibrous tubes, said powder material being inert with respect to said natural cellulosic material and initiating a chemical reaction when exposed to water, wherein a product of said chemical reaction is water;

combing, after said step of drying, said cotton in a direction to substantially longitudinally align said hollow fibrous tubes;

stretching, after said step of combing, said hollow fibrous tubes substantially in said direction wherein said hollow fibrous tubes are placed in a stretched state;

twisting said hollow fibrous tubes in said stretched state substantially about said direction; and compressing, after said step of twisting, said hollow fibrous tubes in said direction, wherein a dried-in strain of said cotton is greatest along said direction, and wherein said hollow fibrous tubes expand along said direction when exposed to moisture.

7. A method according to claim 6 wherein said powder material is selected from the group consisting of: a mixture of sodium bicarbonate and citric acid; and a mixture of sodium bicarbonate and potassium hydrogen tartrate.

8. A method according to claim 6 wherein said powder material is selected such that another product of said chemical reaction is gaseous.

* * * * *